United States Patent [19]

Fluder et al.

[11] 3,943,475

[45] Mar. 9, 1976

[54] LATCH RELAY WITH ELECTRICAL RESET

[75] Inventors: Chester H. Fluder, Wheeling; Matthew R. Heeney, Niles, both of Ill.

[73] Assignee: Vapor Corporation, Chicago, Ill.

[22] Filed: Dec. 6, 1974

[21] Appl. No.: 530,287

[52] U.S. Cl. ..... 335/161; 335/169; 335/170

[51] Int. Cl.[2] ..... H01H 9/20

[58] Field of Search ..... 335/169, 170, 253, 254, 335/161

[56] References Cited

UNITED STATES PATENTS 3,106,625 10/1963 Marley ..... 335/170 X 3,164,757 1/1965 Foster ..... 335/254

*Primary Examiner*—G. Harris

*Attorney, Agent, or Firm*—Francis J. Lidd

[57] ABSTRACT

A relay has an abutment mounted adjacent its armature for movement therewith. A spring-biased tapered pin engages the abutment when the relay is energized. This causes the relay to maintain a latched, first switch state. An electromagnetic releaser is then energized which displaces the pin thus freeing the armature. A spring returns the armature to an unlatched position whereby the relay is set to a second switch state.

10 Claims, 6 Drawing Figures

LATCH RELAY WITH ELECTRICAL RESET

FIELD OF THE INVENTION

The present invention relates to relays, and more particularly to latch relays having an electromagnetic releaser for resetting the relay from a latched state to an unlatched state.

BRIEF DESCRIPTION OF THE PRIOR ART

The advent of modern coordinated mass transit systems has substantially increased reliability requirements for electrical control of trainline systems. One such area is control of electric door operators. Since most of the doors are unattended, electrical indications and signaling of open and closed door operations are crucial. For example, if a door close signal is not completed, the train may either begin to move with the doors open or the train is prevented from moving until a defective component is located.

In particular, trainline pulses of voltage are used to open and close doors. Since pulses are transmitted, latch relays are used to hold the doors open and closed. Consequently, reliable latching or mono-stable operation is crucial to the safety of transit car passengers.

Presently available units, used for the discussed purpose have not performed satisfactorily in vehicular use where failures are of substantial consequence. One prior art approach is to use a symmetrical clapper or armature with a central permanent magnet providing a residual holding force, after momentary energization of a relay coil. However, the residual force is low, and after some time in operation, commonly encountered contaminants, render the latching operation unreliable. That is, that latch contact frequently opens due to shock and/or vibration.

One prior art unit uses a structure similar to that disclosed in U.S. Pat. No. 2,819,364. As constructed, the latch members are subject to wear and consequent loss of latch contact due to vibrations or shock. Additionally, wear of the latch members reduces contact pressure on the contact set "latched," resulting in early contact failure.

The following U.S. patents generally relate to the subject matter of the present invention. However, the presently claimed subject matter defines over these U.S. Pat. Nos: 3,694,779; 2,916,583; 2,819,364; and 1,971,199.

BRIEF DESCRIPTION OF THE INVENTION

It is to be emphasized that although the present invention is discussed in the environment of mass transit electrical door operators, utilization of the invention extends to other uses where mono-stable or mechanically latched and electrically released control relays are considered. However, development of the invention was undertaken to fill, at least, a need in mass transit vehicles for a sufficiently reliable unit.

The invention provides a reliable mechanical latch-electrically released control relay, without sacrificing interruption and/or current carrying capabilities. The latch mechanism is simple, reliable and does not materially affect the operation of the relay switch contacts. The latching mechanism includes a tapered pin having a rounded end which abuts an extension of the relay armature. To reset the relay, the pin is displaced from a latching position thus enabling the armature to snap back to its original switching state. Since the latch pin is tapered and operates near the armature center of gravity, vibration resistance and latching forces are held substantially constant, over a life in excess of two million operations.

The present invention offers significant advantages when compared to the prior art. For example, U.S. Pat. No. 2,916,583, mentioned above, discloses a separate coil which is used to release a mechanical latch on the main relay armature.

The present invention has features which are distinct, when compared to the prior art. For example, when compared to U.S. Pat. No. 2,916,583, the present invention is seen to offer the following:

1. Latching is accomplished by a simple, reliable pin acting on the relay armature very close to its center of gravity. The latch bracket adds very little to armature mass making the unit much more reliable and resistant to shock and vibration than other prior art structures.
2. Addition of the latch requires a negligible increase in basic relay coil power, thereby providing the mono-stable feature without additional circuit penalties.
3. Prior to the introduction of this unit, few if any existing devices could provide reliable latch operation in environments which experience substantial shock and vibration. The unit as described is used extensively on diesel-electric locomotives operating on railroads throughout the U.S. with a failure rate of less than 1 percent.

As will be appreciated, the present invention provides structure which carries out the latch function without major alterations in the armature structure, thereby providing a latch relay which is reliable under adverse environmental conditions. Additionally, the disclosed unit can be classified as a control relay, having substantial current carrying capacity (5–10 amps), whereas prior art units have been pilot relays, having low current capacity (0.5–1.0 amps).

The above-mentioned objects and advantages of the present invention will be more clearly understood when considered in conjunction with the accompanying drawings, in which:

DETAILED DESCRIPTION OF THE INVENTION

Figure 1:
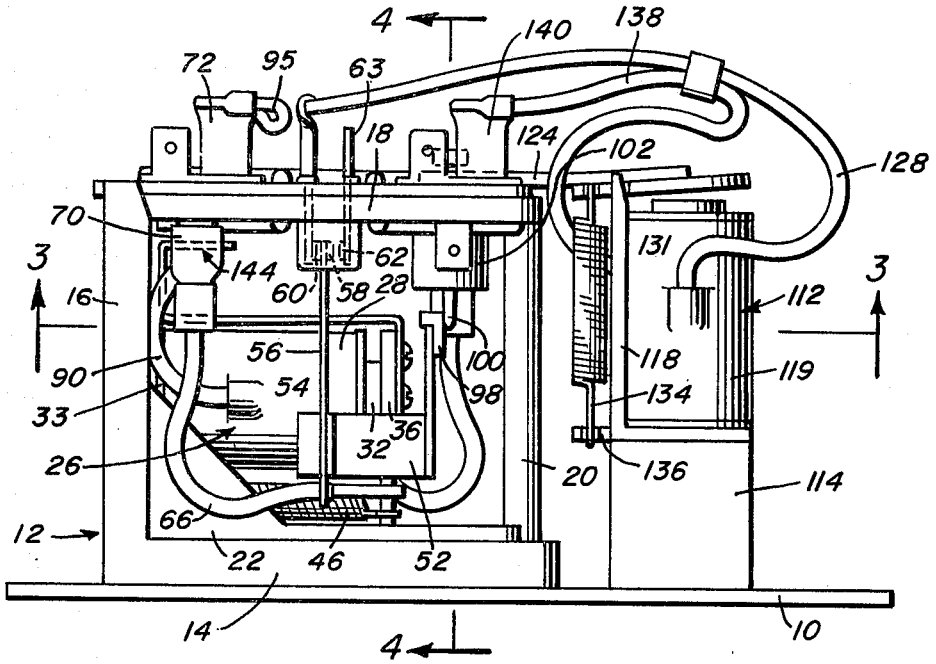
FIG. 1 is a side elevational view of the relay structure shown in an energized state.
Figure 5:
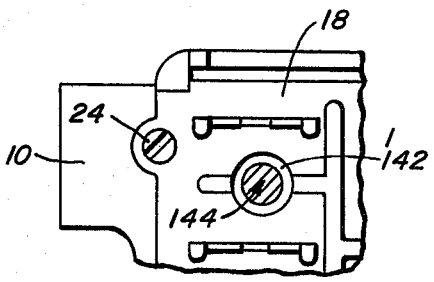
FIG. 5 is a partial top plan view of the present relay structure illustrating a window through which a visual indicator is shown to indicate the state of relay operation.

Referring to the figures and more particularly FIG. 1 thereof, a mounting plate 10 secures a generally U-shaped housing, fabricated from insulator material. The housing includes a lower section 14 that articulates to a vertical section 16. An upper section of the housing 18 is secured to the vertical section 16 by means of fasteners, such as screws 24 (FIG. 5). A cylindrical spacer 20, of insulator material is connected between the upper and lower housing sections 14 and 18. Triangular web sections 22 are positioned in aligned forward and rearward relation, as viewed in FIG. 1, between the vertical section 16 and the horizontal section 14 of the housing 12.

Figure 2:
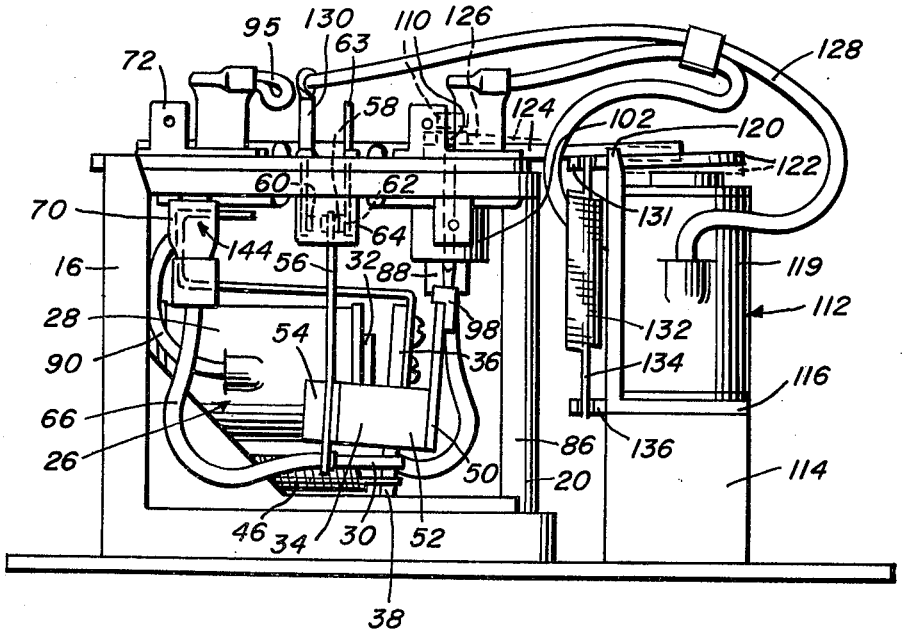
FIG. 2 is a view, similar to FIG. 1, indicating the relay in the de-energized and unlatched state, as well as a transitional switching state (shown by dotted lines).
Figure 4:
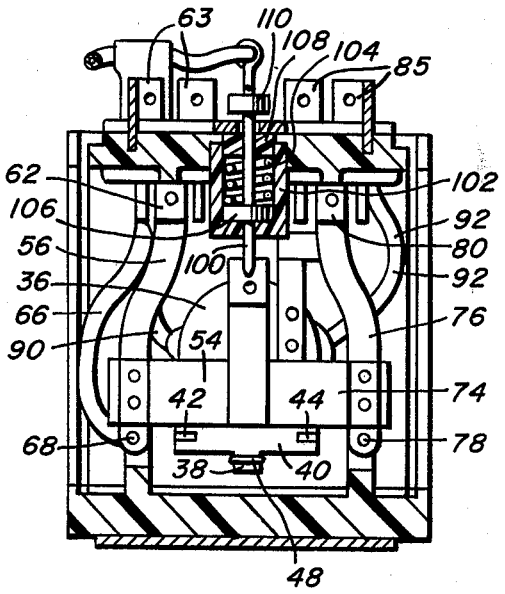
FIG. 4 is a transverse sectional view taken along a plane passing through section line 4—4 of FIG. 1.

A relay, generally indicated by reference numeral 26 is securely mounted at one end of the coil 28 to a vertical bracket section 33 that extends perpendicularly to a second horizontal section 30. The core 32 extends, at the right end of coil 28, with an enlarged diameter 32 to develop desired electromagnetic forces toward the armature 36 of the relay. As seen in FIG. 4, the armature is generally circular, but extends to an integral rectangular portion 40. A small projection 38 extends integrally and transversely of the rectangular portion 40. Notches 42 and 44, best seen in FIG. 4, receive the outward ends of the horizontal bracket section 30 as shown in FIG. 2. Thus, the armature 36 is pivotally mounted iin a cantilever fashion to the rectangular section 40 of the armature 36. As shown in FIG. 2, a coil spring 46 is attached at one end to the projection 38, and the opposite end is mounted to the left end (not shown) of the horizontal bracket section 30. The spring 46 normally biases the armature 36 in the position shown in FIG. 2.

Referring to FIG. 2, a generally U-shaped yoke 34 is shown mounted to the armature 36 for linked movement therewith. The yoke 34 is fabricated from an insulator material and mounts a metal member 50 at the outward right end thereof. The metal member 50 extends upwardly to an L-shaped abutment 98, to be discussed hereinafter. The yoke 34 has parallel spaced horizontal sections 52 that extend to the left end thereof to shoulder portions 54 and 74, more clearly shown in FIG. 4. The shoulder portion 54 mounts a contact arm 56 that extends upwardly to a relay contact 58 that is associated with the contact set 60 and 62, better seen in FIG. 2. Also in FIG. 2, the contacts 58 and 62 are seen to be in a normally closed position while the contacts 58 and 60 are seen to be in a normally opened position. The contacts are shrouded by an integral shroud 64 which protects the contacts.

As previously mentioned, FIG. 2 illustrates the relay in a first switching state. During this state, current passes from the exterior terminal 72 to the inward terminal 70. A flexible wire 66 is then connected between the terminal 70 and a connection point 68, best shown in FIG. 4. The connection point enables the current to continue its travel along the contact arm 56 to the movable contact 58. In the relay state shown in FIG. 2, contact is made between the contact set 58–62. An exterior terminal 63 is provided to pick off the current when the relay is in the state shown in FIG. 2.

Figure 3:
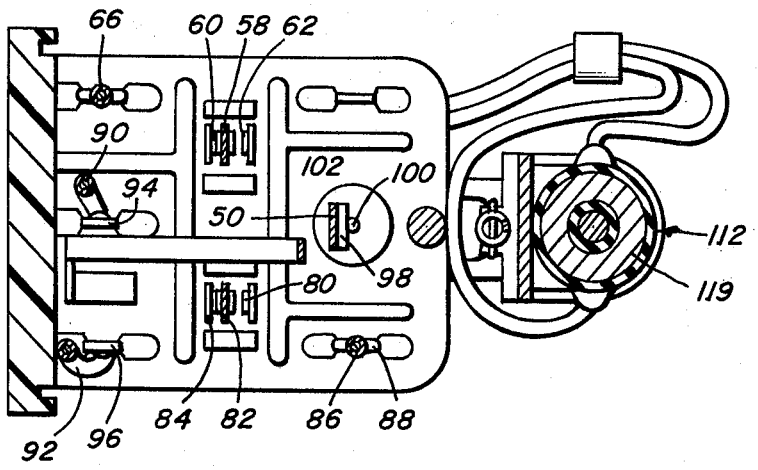
FIG. 3 is a sectional view taken along a plane passing through section line 3—3 of FIG. 1.

A similar situation exists with a second set of relay contacts. Referring to FIG. 4, a yoke shoulder 74 is illustrated as being symmetrical and identical to the previously mentioned shoulder 54. A second contact arm 76 extends from the shoulder to a movable contact 82 (FIG. 3). Stationary contacts 80 and 84 are symmetrically utilized as contacts 62 and 60, respectively, as previously described. In the relay state of FIG. 2, the movable contacts 58 and 82, respectively, contact the stationary contacts 62 and 80. The relationship between contact pairs, during a second switching or latched condition, as shown in FIG. 1, corresponds with the view of FIG. 3.

The path of current from contact arm 76 is through the wire 86 (FIG. 2). A first end of this wire is connected to the external terminal 88 (FIG. 3). The opposite end of the wire is connected to point 78 (FIG. 4). The stationary contact 62 corresponds with the external terminals 63 in FIG. 4, while stationary contact 80 corresponds with external terminals 85 in FIG. 4.

When the relay is in the switching state shown in FIG. 1, the movable contacts 58 and 82, of FIG. 3, contact the stationary contacts 60 and 84, which in turn have external terminals similar to terminals 63 and 85 in FIG. 4.

Thus far, the current switching has been described with respect to the relay contacts, as they assume two switching states shown in FIG. 1 and FIG. 2.

The following disclosure will relate to energization of the relay 26 so that it may be switched between the first and second states, as illustrated in FIG. 1 and FIG. 2. A wire 90 extends inwardly from the external terminal 94 (FIG. 3). The opposite end is connected to the first end of the relay coil 28. The opposite end of the coil is connected to wire 92 (FIGS. 3 and 4), which in turn is connected to the external terminal 94. This describes the energizing current path for the relay 26. When current passes through the described circuit path, the relay armature changes from the position shown in FIG. 2, to the position shown in FIG. 1. It will be noted that the armature 36 has moved inwardly into contact with the relay coil core.

With the latch released and relay coil de-energized as shown in FIG. 2, the metal member 50 mounted to the yoke 34 is seen to extend outwardly to an L-shaped member 98 which serves as an abutment to the spring-loaded tapered pin 100, which has a smooth rounded end contacting the abutment 98. The abutment may be fabricated from a suitable low friction-good wearing material, such as NYLATRON. The pin or plunger 100 is concentrically mounted within a cylindrical housing 102 shown in FIG. 4. It will be noted that the plunger 100 has a bearing element 106 concentrically mounted to it, and located inwardly of the plunger housing 102. A spring 104 is concentrically disposed around the plunger and bears against the member 106 and a retainer member 108. Thus, the plunger 100 is biased outwardly against the L-shaped member 98, shown in FIG. 2. When the relay coil 28 is energized, the armature 36 is attracted toward the coil and the L-shaped member 98 moves along with the armature 36 until the plunger 100 abuts the abutment 98, as shown in FIG. 1, wherein detent action is accomplished between the plunger 100 and the abutment 98. This achieves latching action of the relay. In order to release the relay, thereby allowing it to return to its original state in FIG. 2, the external projection 110, shown in FIG. 4, connected to the plunger 100, must be moved outwardly thereby permitting the spring 46 (FIGS. 1 and 2) to snap the relay armature and the L-shaped member 98 to the original position shown in FIG. 2. In order to appreciate how this resetting of the latch is accomplished, reference is made to FIG. 2 wherein an electromagnetic releaser 112 is illustrated. The releaser is supported by an insulating block 114. The coil 119 of the releaser is secured to the horizontal portion 116 of a bracket that has a vertical portion 118. The upper end of the vertical portion 118 is bifurcated to receive a notched portion of the releaser armature 122. The armature 122 is mounted in a pivotally cantilevered manner, as was in the case of relay armature 36. An elongated metal member 124 is bifurcated at the outward end 126 thereof to receive the projection 110 (FIG. 2) of plunger 100. A first wire 128 is connected to one end of the coil 119. The opposite end of wire 128 is connected to terminal 130, which in turn is connected to the contact 60. Thus, wire 128 is energized when the relay maintains the energized state, shown in FIG. 1.

A projection 131 extends from the left end of armature 122, as shown in FIG. 2, and serves to connect the upper end of spring 132. The lower end of the spring 134 is secured at 136 to an outwardly extending projection from the horizontal bracket section 116. Thus, the releaser armature is normally biased outwardly, which in turn causes member 124 to assume the position shown in FIG. 1. An external terminal 140 is connected to the first end of wire 138, the opposite end being connected to coil 119 to complete a current path through the releaser coil.

Figure 6:
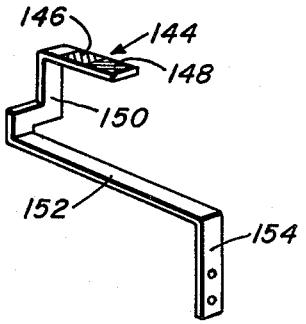
FIG. 6 is a perspective view of a flag member which is positioned adjacent the window of FIG. 5.

In operation of the device, when relay 26 is energized, the armature 36 of the relay is latched into position due to the detent action of the tapered plunger 100. This is a situation illustrated in FIG. 1. Such would be the case in the environment of a mass transit vehicle, when a door opener has been activated. In order to close the doors, a door closing pulse signal is transmitted to terminal 140 which completes a circuit through coil 119 thereby momentarily energizing the releaser 112. Referring to FIG. 2, such energization draws the armature 122 downwards as shown by the dotted position, and releases the latching action of the tapered pin 100 by momentarily raising it as shown in dotted lines and returning the relay 26 to the position shown in FIG. 2. As will be appreciated, only upon proper electrical energization of the releaser will the plunger 100 be released from its abutting relation with the L-shaped member abutment 98, as shown in FIG. 1. When such energization does occur, the relay armature and changed switching state will take place, as illustrated in solid lines in FIG. 2. In order to provide a visual indication as to whether relay 26 is energized or de-energized, a visual indicator is provided as shown in FIG. 5. Specifically, a window 142 is provided on the upper housing section 18. A mechanical flag shown in FIG. 6 is mounted to the armature of relay 26, and depending upon the state of the relay, the flag will assume a different position. Due to the inclusion of differently colored portions on the flag, when the flag moves between two extreme positions, a color code is shown through window 142, to indicate the state of the relay. The mechanical flag of FIG. 6 includes an indicator section generally indicated by reference numeral 144 which includes a red painted section 148 and a green painted section 146. The painted section articulates to an intermediate section 150 which in turn articulates to an elongated section 152 maintained in parallel spaced relation to the indicating portion 144. Finally, a perpendicular mounting portion 154 is provided to secure the entire flag of FIG. 6 to the armature of relay 26.

In order to appreciate the operation of the flag, reference is made to FIG. 2 which shows relay 26 in the de-energized position. The indicating portion 144 of the flag is so positioned to permit the viewing of the green color through window 142 (FIG. 5). However, when the relay is energized, and the armature is latched in the position shown in FIG. 1, the red color is shown through the window and an observer can detect that the relay is assuming a latched condition. The inclusion of the flag indicator is invaluable during troubleshooting.

It should be understood that the invention is not limited to the exact details of construction shown and described herein for obvious modifications will occur to persons skilled in the art.

Wherefore the following is claimed:

1. A latch relay assembly comprising:

a coil having an armature mounted in movable relation therewith;

switching means connected to the armature for switching the relay between at least two states;

abutment means, of relatively low mass, connected to the armature;

movable plunger means mounted adjacent the abutment means for abutting the abutment means near the center of gravity of the armature, when the relay is energized, thus latching the relay in a first relay state; and electrical means connected to the plunger means for releasing the plunger means from abutting the abutment means thus returning the relay to a second relay state, when the relay is de-energized;

whereby the relatively low mass of the abutment means and the disposition of the plunger means near the center of gravity of the armature render the relay resistant to shock and vibration.

2. The subject matter of claim 1 wherein the abutment means comprises a low friction and long wearing member disposed in adjacent proximate relation to the armature.

3. The subject matter of claim 1 wherein the plunger means comprises a pin member having a rounded end for engaging the abutment means.

4. The subject matter of claim 2 further wherein the plunger means comprises a pin member having a rounded end for engaging the abutment means.

5. The subject matter of claim 4 wherein the electrical releasing means comprises an electromagnetic actuator normally biased in non-contacting relationship with the plunger means, the actuator moving to containing relation with the plunger means when the plunger means is released during transition from the first state to the second state.

6. The subject matter of claim 5 together with visual signalling means connected to the armature to signify which state the relay is in.

7. The subject matter of claim 6 wherein the signalling means comprises a flag mechanism having differently colored portions that are selectively viewable through an observation window to signify which state the relay is in.

8. The latch relay comprising:

a coil;

an armature positioned in movable spaced relation to the coil;

an insulator yoke mounted perpendicularly to the armature;

low mass support means connected in cantilever fashion to the yoke, in parallel spaced relation to the armature;

low mass abutment means mounted to the outward end of the support means; and plunger means mounted near the armature center of gravity for abutting the abutment means when the relay is energized, thus latching the armature in a first state; and electromagnetic means connected to the plunger means for terminating the abutting relationship, thus returning the armature to a second state when the relay is de-energized;

whereby the relatively low mass of the abutment means and the disposition of the plunger means near the center of gravity of the armature render the relay resistant to shock and vibration.

9. The subject matter of claim 8 wherein the abutment means comprises a low friction and long wearing member disposed in adjacent proximate relation to the armature.

10. The subject matter of claim 9 further wherein the plunger means comprises a pin member having a rounded end for engaging the abutment means.

* * * * *

UNITED STATES PATENT OFFICE
CERTIFICATE OF CORRECTION

PATENT NO. : 3,943,475

DATED : March 9, 1976

INVENTOR(S) : Chester H. Fluder and Matthew R. Heeney

It is certified that error appears in the above-identified patent and that said Letters Patent are hereby corrected as shown below:

Column 3, line 22, "iin" should read --- in ---;

Column 6, line 43 and 44, "containing" should read --- contacting ---.

Signed and Sealed this

Sixth Day of July 1976

[SEAL]

*Attest:*

RUTH C. MASON
*Attesting Officer*

C. MARSHALL DANN
*Commissioner of Patents and Trademarks*